United States Patent [19]

Anderson

[11] Patent Number: 4,563,672

[45] Date of Patent: Jan. 7, 1986

[54] MICROPROCESSOR AUTOMATIC PROGRAM FAIL RESET CIRCUIT

[75] Inventor: Stephen F. Anderson, Flower Mound, Tex.

[73] Assignee: Wormald U.S., Inc., Marinette, Wis.

[21] Appl. No.: 577,830

[22] Filed: Feb. 7, 1984

[51] Int. Cl.[4] ..... G08B 29/00

[52] U.S. Cl. ..... 340/512; 340/509; 340/526

[58] Field of Search ..... 340/512, 518, 506–514, 340/526, 825.65, 825.67, 825.57, 652, 653, 657, 309.15, 309.4; 331/62, 64

[56] References Cited

U.S. PATENT DOCUMENTS 3,806,872 4/1974 Odom ..... 340/518
3,940,739 2/1976 Quimet ..... 340/518
3,978,478 8/1976 Schmitz ..... 340/506
4,151,522 4/1979 Yamauchi ..... 340/309.15
4,408,299 10/1983 Young ..... 340/309.15

FOREIGN PATENT DOCUMENTS 2095881 10/1982 United Kingdom ..... 340/512

*Primary Examiner*—Donnie L. Crosland
*Attorney, Agent, or Firm*—Morgan, Finnegan, Pine, Foley & Lee

[57] ABSTRACT

In a microprocessor controlled fire alarm system, a chain of continuous pulses is generated by the microprocessor. The chain of continuous pulses is monitored, and if there is an interruption in the chain of continuous pulses a signal is generated to automatically reset the microprocessor.

3 Claims, 3 Drawing Figures

MICROPROCESSOR AUTOMATIC PROGRAM FAIL RESET CIRCUIT

BACKGROUND OF THE INVENTION

The apparatus of the present invention relates to alarm systems and more specifically to a fire protection system under microprocessor control.

In a microprocessor based fire protection system it is extremely important that the microprocessor maintain control over the system at all times. An electrical transient has the potential for causing the microprocessor to become lost and therefore, causing it to discontinue its correct program sequence. When the program sequence is discontinued, the fire protection control unit is completely disabled and such an occurrence could be catastrophic in the event of a fire.

A typical example of a control unit for a microprocessor based fire protection system is the Model 1100 Wormald Single Zone Fire Protection Releasing Control Unit manufactured and sold by Wormald Data Systems. The control unit includes a power supply, a microcomputer, and associated circuitry for controlling a plurality of supervised or unsupervised circuits connected to fire alarms, smoke detectors, fire suppression devices, etc.

SUMMARY OF THE INVENTION

The present invention relates to an improved fire protection system under microprocessor control. The fire protection system includes a microprocessor based control unit for controlling input devices such as smoke detectors, flame detectors and manual fire alarms; output devices such as horns or flashing lights; and fire suppression devices such as sprinklers. The invention further includes circuitry for monitoring a continuous chain of pulses generated at predetermined time intervals and circuitry for generating a resetting pulse when an interruption such as an electrical transient interrupts the chain of pulses from the microprocessor. The resetting pulse is interpreted by the microprocessor as an indication that there has been a disruption and the software of the microprocessor causes the microprocessor to be restarted in the correct program sequence.

DETAILED DESCRIPTION OF THE INVENTION

Figure 1:
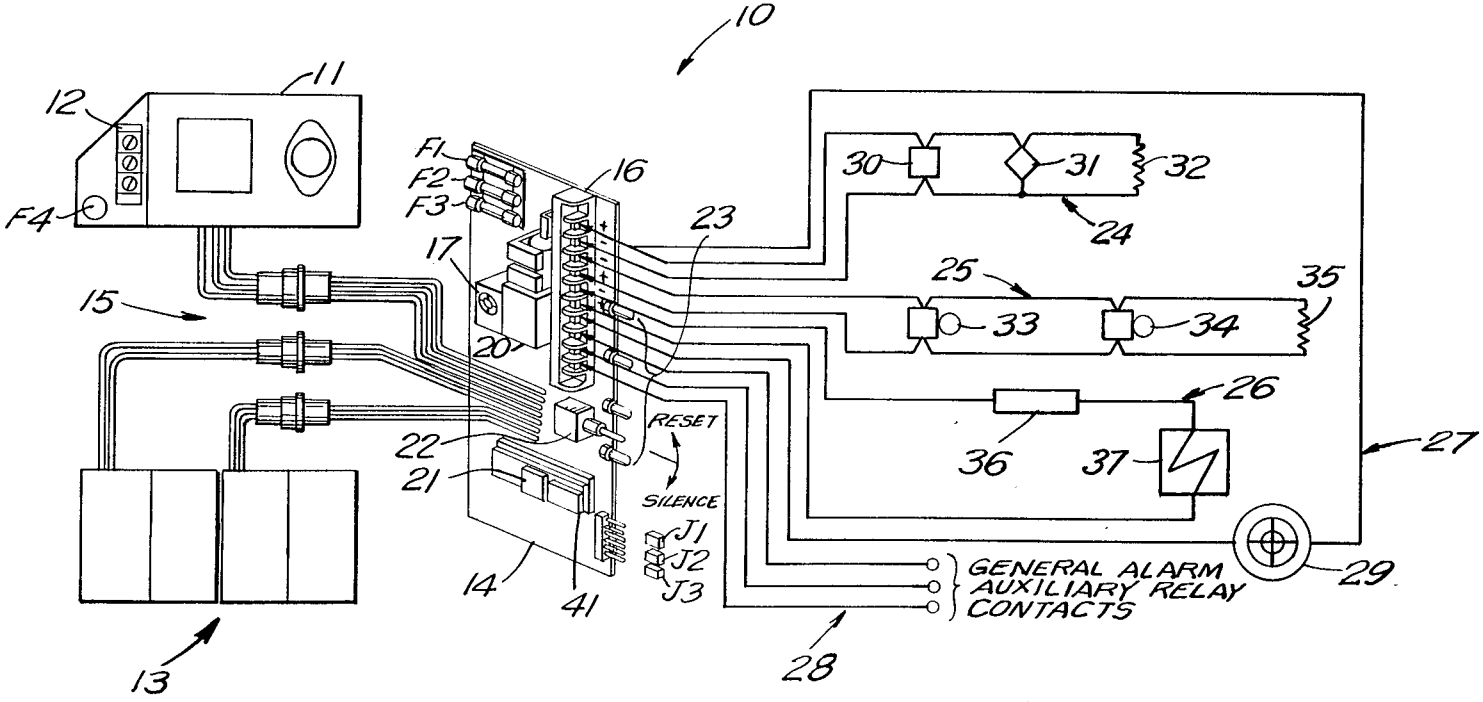
FIG. 1 is a schematic diagram of the microprocessor based fire protection system of the present invention.

Referring now to FIG. 1, a schematic diagram of the microprocessor based fire protection system 10 of the present invention is provided. The fire protection system includes a regulated power supply 11 which is connected to an a.c. source by a connection block 12 to provide a maximum of 28 VDC. A battery pack 13 is provided as a backup to the power supply 11 in the event of a power failure. The regulated power supply 11 also preferably includes a charging circuit to recharge the battery pack 13 and a fuse F4. The regulated power supply 11 and the battery pack 13 are connected to a printed circuit board 14 by wiring harnesses 15.

The printed circuit board 14 includes a plurality of fuses F1, F2, F3; a terminal block 16; an audible alarm 17; electronic circuitry 20; a microprocessor 21; an integrated circuit 41; a switch 22; jumpers J1, J2, J3; and a plurality of L.E.D.'s 23.

The terminal block 16 is used to connect a supervised input circuit 24, a supervised alarm circuit 25, a supervised releasing circuit 26, an unsupervised discharge alarm circuit 27, and unsupervised auxiliary contacts 28 to the printed circuit board 14. The supervised input circuit 24 is typically comprised of devices such as a manual pull station 30, a thermal detector 31 and an end of line resistor 32. The supervised alarm circuit 25 is typically comprised of general audible alarms 33, 34 and an end of line resistor 35. The supervised releasing circuit 26 is typically comprised of a supervisory resistor diode device 36 and a release solenoid 37 for activating a suppression system actuator connected to a sprinkler system or other fire suppression device. The unsupervised pre-discharged alarm circuit 27 includes an audible alarm 29 for providing a warning prior to the actuation of the fire suppression device connected to the release solenoid 37. The unsupervised auxilary relay controls 28 are controlled by a Form C, SPDT relay and are useful in providing startup or shutdown operations of equipment such as fans, dampers, computers, etc.

The switch 22 on printed circuit board 14 is useful for silencing alarms, silencing a trouble, resetting the unit, performing a lamp and buzzer test, and performing diagnostics for the cause of a trouble. The buzzer 17 and L.E.D.'s 23 are useful for providing an indication of trouble or providing a warning.

The microprocessor 21 is used to control the various circuits described above. The microprocessor 21 preferably includes a Motorola 68705R3 8-bit device with 256 bytes of RAM (random access memory) and 4 kilobytes of PROM (programmable read only memory).

Figure 2:
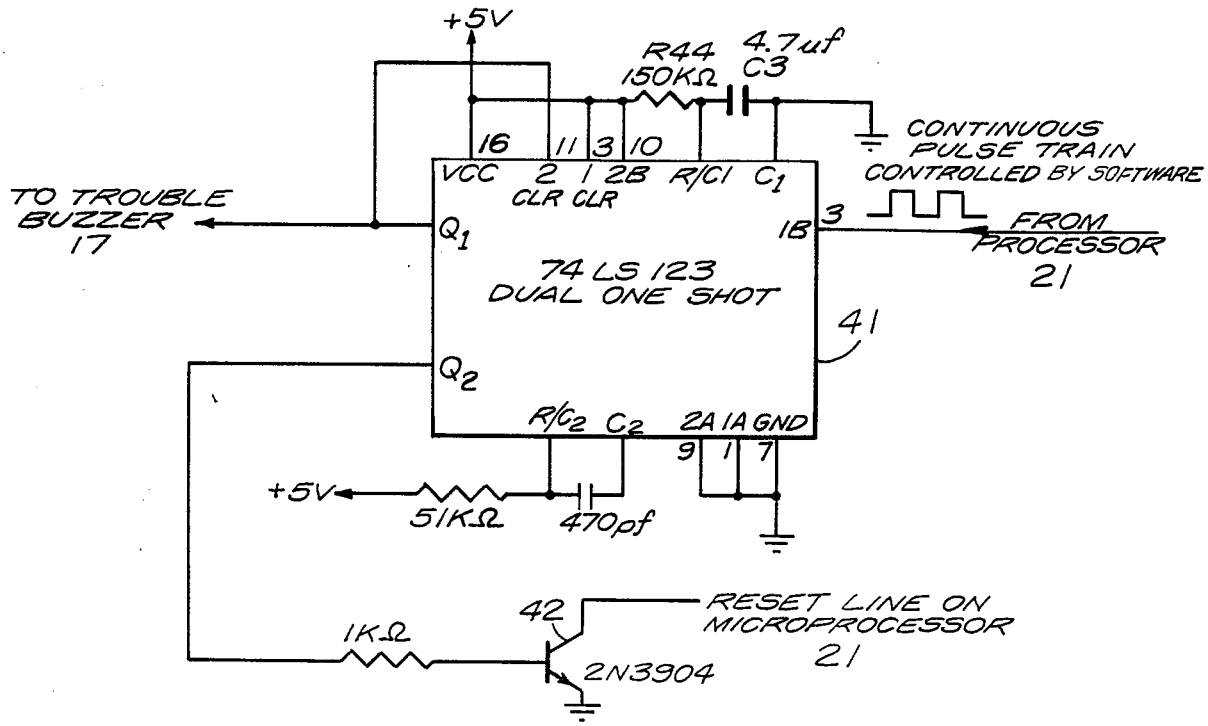
FIG. 2 is a schematic diagram of the circuitry used to reset the microprocessor.

Referring now to FIG. 2, a schematic diagram of circuitry used to reset the microprocessor 21 is provided. The circuitry includes a dual retriggerable monostable multivibrator 41 which is preferably of the type commercially sold as an integrated circuit under device number 74LS123. The first one shot of device 41 is continually maintained in an "on" state; that is the $Q_1$ bar output remains low and the $Q_1$ output remains high as along as the pulses from the microprocessor 21 are uninterrupted. If the microprocessor program fails to execute in the correct sequence, so that it no longer causes the data line connected to the first one shot to pulse at the correct time the first one shot will turn off. This will cause an upward transition on the pin $Q_1$ bar which in turn triggers the second one shot. The second one shot then generates a short pulse on the output $Q_2$ which provides a reset pulse to microprocessor via the transistor 42. When $Q_1$ goes low the trouble buzzer 17 is sounded.

Figure 3:
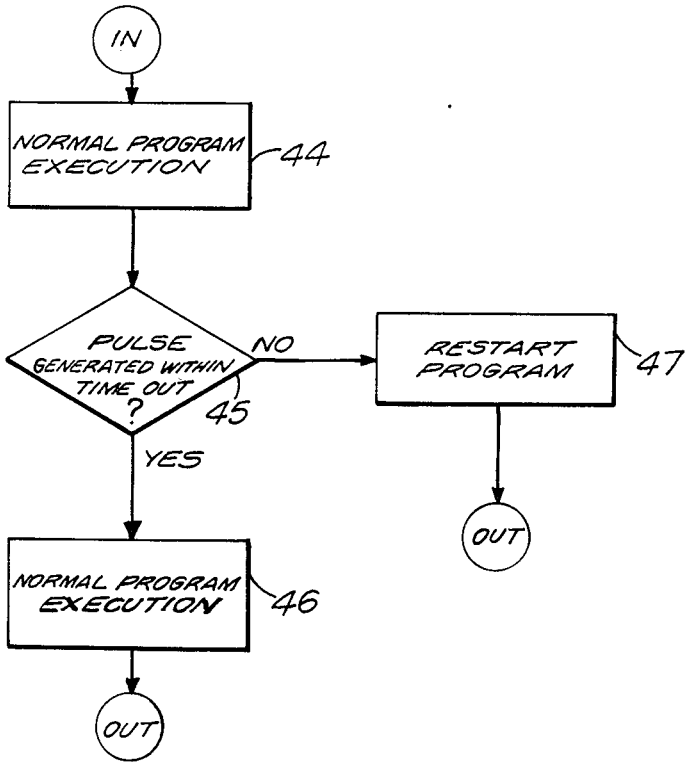
FIG. 3 is a block diagram of the control logic for the microprocessor based fire protection system.

Referring now to FIG. 3, a block diagram of the logic used to reset the microprocessor 21 is provided. During a first normal program execution 44, the software associated with microprocessor 21 generates a short pulse. The first one shot of the retriggerable dual monostable multivibrator 41 is reset ($Q_1$ goes low) by the short pulse generated by a particular group of software instructions. The decision block 45 signifies that the program must return to this set of instructions periodically to ensure that the first one shot remains reset. As long as the program returns to this group of instructions before the first one shot times out, $Q_1$ will remain low and a second iteration of the normal program 46 can occur. This can only be accomplished if the program is operating properly. If the second one shot which acts as a timer times out, the rising edge of output $Q_1$ triggers the second one shot of the monostable multivibrator 41. The second one shot generates a short pulse at the $Q_2$ output to turn on the transistor 42 which brings the system reset line low, thereby resetting the microprocessor 21. With the falling edge of the short pulse at $Q_2$, the reset line is released and the microprocessor 21 attempts a restart sequence of instructions 47 returning the computer to normal operation. As long as the microprocessor 21 operates normally the control unit is able to control the circuits 24–28 and provide adequate protection.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed:

1. An alarm system of the type having processing means located in a central station for controlling a plurality of remote input and output devices, wherein the improvement comprises:

first one shot means for monitoring a chain of continuous pulses generated at predetermined time intervals by said processing means;

second one shot means for generating a resetting pulse, responsive to said first one shot means such that when there is an interruption in the chain of continuous pulses, the resetting pulse resets said processing means; and indicating means responsive to said first one shot means for providing an indication that a resetting signal has not reset said processing means.

2. An alarm system according to claim 1 wherein said indicating means includes a buzzer.

3. An alarm system according to claim 2 which further includes a transistor responsive to the output of said second one shot means.

* * * * *